US005547309A

United States Patent [19]

Mak et al.

[11] Patent Number: 5,547,309

[45] **Date of Patent: *Aug. 20, 1996**

[54] THRIE-BEAM TERMINAL WITH BREAKAWAY POST CABLE RELEASE

[75] Inventors: King K. Mak, San Antonio; Roger P. Bligh; Hayes E. Ross, Jr., both of Bryan, all of Tex.; Dean L. Sicking, Lincoln, Nebr.

[73] Assignee: The Texas A&M University System, College Station, Tex.

[ * ] Notice: The term of this patent shall not extend beyond the expiration date of Pat. No. 5,407,298.

[21] Appl. No.: 362,654

[22] Filed: Dec. 22, 1994

Related U.S. Application Data

[63] Continuation-in-part of Ser. No. 78,020, Jun. 15, 1993, Pat. No. 5,407,298.

[51] Int. Cl.[6] ..... E01F 15/00

[52] U.S. Cl. ..... 404/6; 256/13.1

[58] Field of Search ..... 404/6, 9, 10, 11; 256/13.1, 1

[56] References Cited

U.S. PATENT DOCUMENTS

| | | | |
|---|---|---|---|
| 4,678,166 | 7/1987 | Bronsted et al. | 256/13.1 |
| 4,838,523 | 6/1989 | Humble et al. | 256/13.1 |
| 5,022,782 | 6/1991 | Gertz et al. | 404/6 |
| 5,078,366 | 1/1992 | Sicking et al. | 404/6 X |
| 5,286,137 | 2/1994 | Cicinnati et al. | 256/13.1 |
| 5,391,016 | 2/1995 | Ivey et al. | 404/6 |
| 5,407,298 | 4/1995 | Sicking et al. | 404/6 |

FOREIGN PATENT DOCUMENTS

| | | | |
|---|---|---|---|
| 379424 | 7/1990 | European Pat. Off. | 256/13.1 |
| 1179236 | 10/1964 | Germany . | |
| 1337271 | 11/1973 | United Kingdom | 256/13.1 |

OTHER PUBLICATIONS

Sicking, Dean L. et al., "Development of New Guardrail End Treatments," Research Report 404–1F, Texas Transportation Institute, Oct. 1988.

*Primary Examiner*—Michael Powell Buiz
*Assistant Examiner*—James A. Lisehora
*Attorney, Agent, or Firm*—Conley, Rose & Tayon

[57] ABSTRACT

An end treatment for a thrie-beam type guardrail and safety device specifically oriented toward trucks, vans and other utility vehicles having high profiles and centers of gravity. A slotted thrie-beam terminal is featured for use with highway guardrail systems. At least one reinforced slotted section is provided within the thrie-beam terminal to reduce the ability of the thrie beam to resist buckling in response to an axial type loading from end-on impacts. The terminal also provides for gating of laterally impacting vehicles. The terminal incorporates a break-away support post cable release mechanism which lessens risk to impacting vehicles which impact the lead post.

6 Claims, 3 Drawing Sheets

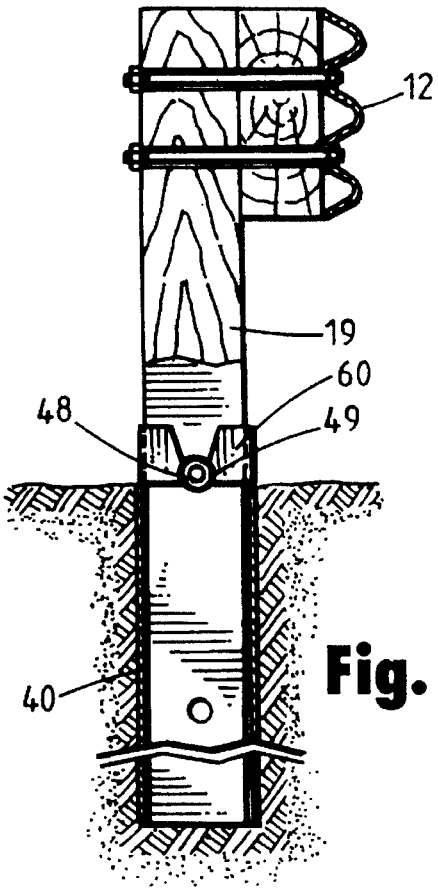
Fig. 4
Fig. 5
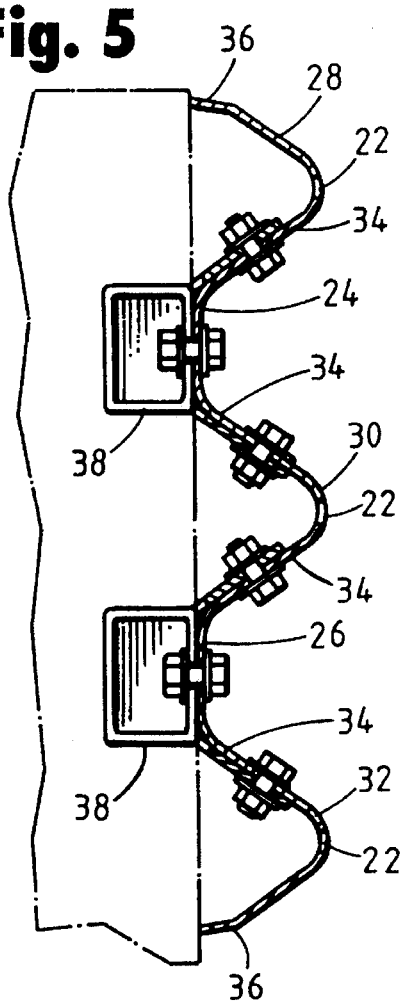
Fig. 6
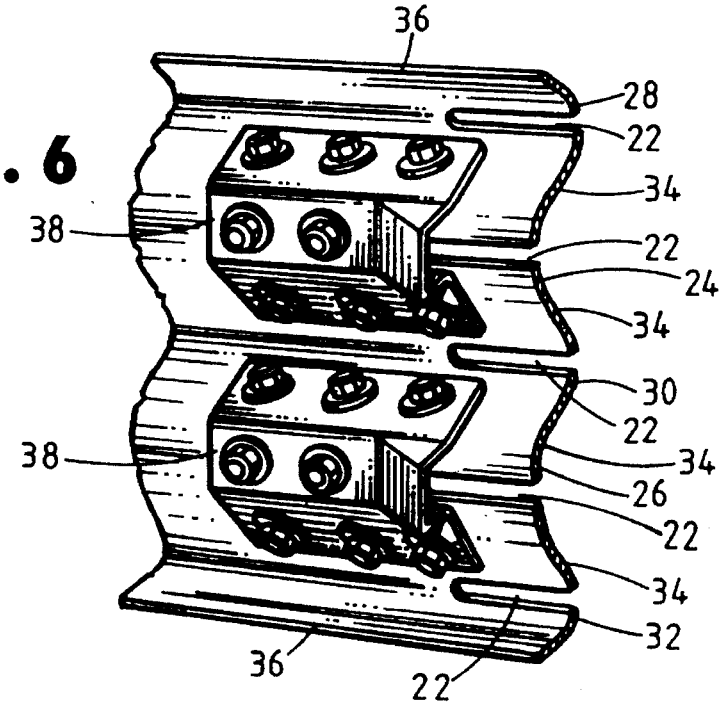

THRIE-BEAM TERMINAL WITH BREAKAWAY POST CABLE RELEASE

BACKGROUND OF THE INVENTION

This is a continuation-in-part of application Ser. No. 08/078,020 filed on Jun. 15, 1993, now U.S. Pat. No. 5,407,298.

This application is a continuation-in-part of Ser. No. 08/078,020 filed Jun. 15, 1993.

FIELD OF THE INVENTION

The present invention relates generally to highway guardrail systems and road barriers. More particularly, the invention relates to improved new treatments for guardrail systems.

DESCRIPTION OF THE RELATED ART

Pickup trucks, vans and other utility vehicles (hereinafter referred to as light trucks) have become increasingly popular in recent years. It has been estimated that over twenty-five percent of United States drivers own and operate a light truck, and this number may grow to represent one-third of the vehicle fleet. The Intermodal Surface Transportation Efficiency Act of 1991 specifically directed the Secretary of Transportation to revise guidelines and standards for acceptable roadside barriers and other safety appurtenances, including longitudinal barriers, end terminals, and crash cushions, to accommodate these light trucks.

Light trucks generally have higher bumpers and higher centers of gravity than passenger cars and their impact performance is significantly different from that of passenger cars. In recognition of the increasing popularity of light trucks and the differences between light trucks and passenger cars, national highway safety standards are changing. Updated guidelines for safety performance evaluation of highway features, set forth in National Cooperative Highway Research Program (NCHRP) Report 350, recommends that highway safety devices, such as guardrails, end terminals, and crash cushions, be crash tested and evaluated with a ¾ -ton pickup truck serving as a surrogate for all light trucks. NCHRP Report 350, issued in 1993, has been adopted by the Federal Highway Administration (FHWA) as the guidelines for crash testing and evaluation of all new highway safety features.

The growing popularity of light trucks is leading to a rethinking in highway safety technology. One example is the thrie beam, which has been used in a number of states, such as California, Colorado, Massachusetts, Michigan, Nevada and Utah, as median and roadside barriers. The thrie beam is a corrugated metal rail which is typically installed on support posts along the roadside much as a standard W-shaped guardrail beam or "W-beam" would be. A thrie beam is wider than a standard W-beam rail, and, when installed, the width extends both above and below that of a W-beam guardrail. As such, it affords greater safety for drivers of light trucks than the W-beam, as it may be installed to coincide with the greater bumper heights of these vehicles.

Although many suitable end treatments are known for W-beam guardrails and other standard guardrail designs, there are few suitable end treatments for the thrie beam design. The most common end treatments currently in use with the thrie beam guardrail are the turned-down end terminal and the transition to a W-beam rail with a crashworthy W-beam end terminal. A proprietary guardrail end treatment, known as SENTRE, manufactured by Energy Absorption Systems, Inc., is also adoptable for use as an end terminal for thrie beam guardrails.

The turned-down end terminal involves sloping the end of the thrie beam down and affixing it into the ground. This end treatment eliminates the problem of vehicles spearing or impaling on the raised ends of the guardrail, but the design provides a ramp that, under certain impact conditions, could launch and vault the vehicle to the extent of becoming airborne for a considerable distance with the possibility of rollover. Indeed, the FHWA, in a memorandum dated Sep. 29, 1994, prohibited the use of turned-down end terminals on high-speed, high-volume roadways on the National Highway System (NITS).

Using a specially fabricated transition section, the thrie beam rail can be transitioned to a W-beam rail and then terminated with crashworthy W-beam end terminal design. However, since the W-beam rail has a reduced capacity compared to the thrie-beam, this type of design increases the required length of guardrail. This, in turn, increases the overall cost of the end treatment.

The SENTRE end terminal is constructed from a series of breakaway steel guardrail posts and frangible plastic containers containing sandbags. Impacting vehicles are decelerated as the guardrail posts release and sand bags in the plastic containers are impacted. A cable is used to guide vehicles away from the guardrail during impact. This system is very expensive, and has not gained wide acceptance.

Related potential hazards are presented by guardrail support posts, whether those posts support a W-beam rail or a thrie beam rail. An end-on impact with an unmodified support post could result in ramping or vaulting of the vehicle. Breakaway support post arrangements are known wherein a frangible post is used which will shear or break away during an impact. The lead post, i.e., the post nearest the upstream end of the terminal, is typically provided with a tension support cable which extends between an unsupported point on the rail and the lower portion of the lead post. The lead post end of the cable is provided with a threaded metal fitting which is passed through a drilled hole in the lower portion of the post. A rectangular metal bearing plate with washer and nut are fastened on the end of the fitting. The tension support cable is designed to disengage when the post breaks away. However, results of crash tests have shown that the bearing plate may snag portions of the impacting vehicle and cause the vehicle to become entangled in the cable, resulting in the vehicle being brought to an abrupt halt.

SUMMARY OF THE INVENTION

The present invention provides a suitable end treatment for a thrie-beam type guardrail and a safety device specifically oriented toward pickup trucks, vans and other utility vehicles having high profiles, bumper heights and centers of gravity. It features a slotted thrie-beam terminal for use with highway guardrail systems. At least one reinforced slotted section is provided within the thrie-beam terminal to reduce the ability of the thrie beam to resist buckling in response to an axial type loading from end-on impacts. The terminal provides for gating of impacting vehicles. The present invention also includes a break-away support post cable release mechanism which lessens risk to impacting vehicles which break away the lead post during end-on impacts.

BRIEF DESCRIPTION OF THE DRAWINGS

FIG. 4 is a cross-sectional view of an exemplary end terminal.

FIG. 5 is a cross-sectional detail illustrating attachment of slot guards.

FIG. 6 is an isometric detail showing attachment of slot guards proximate the downstream end of a slotted section.

DETAILED DESCRIPTION OF THE PREFERRED EMBODIMENTS

Figure 1:
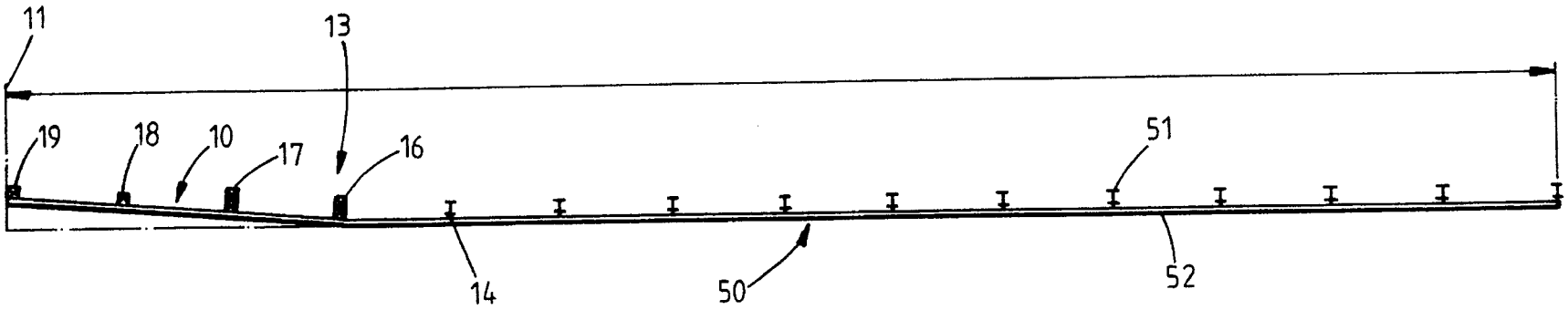
FIG. 1 is a plan view of a portion of an exemplary thrie-beam guardrail incorporating an end terminal constructed in accordance with the present invention.
Figures 2, 3:
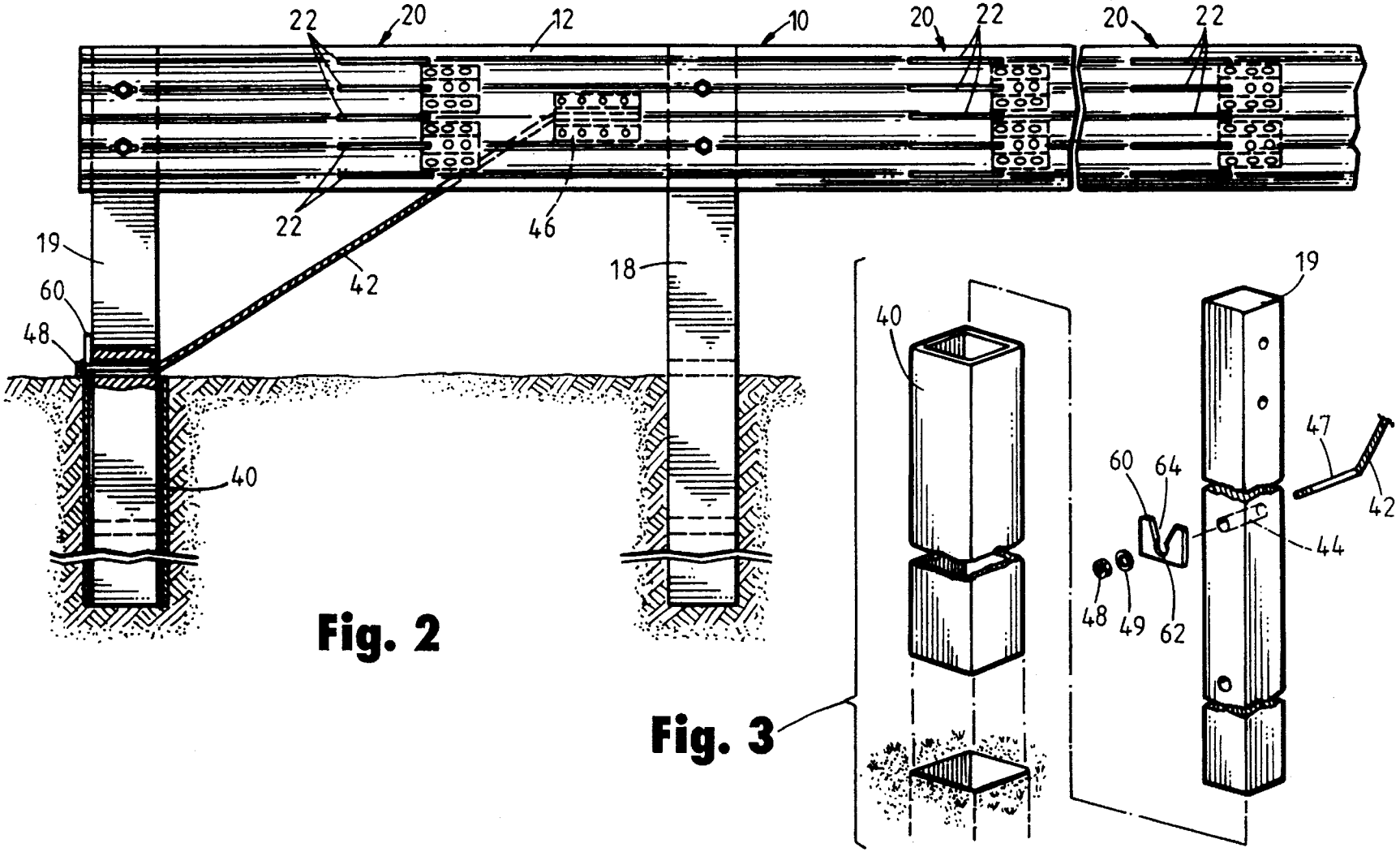
FIG. 2 is a side view of upstream portions the end terminal of FIG. 1.
FIG. 3 is an exploded view detailing portions of an exemplary breakaway post cable release constructed in accordance with the present invention.

The present invention offers an end terminal suitable for a thrie-beam guardrail. Referring first to FIGS. 1 and 2, an exemplary guardrail 50 is shown wherein a thrie-beam rail 52 is supported by posts 51 along its length. It may be appreciated that the guardrail 50 may be positioned alongside a roadway just as a more common and conventional guardrail would be, parallelling the roadway upon which traffic passes in the direction indicated by the arrows in FIG. 1. Terminal 10 is connected to the end of the guardrail 50. When so installed, terminal 10 presents an upstream portion 11 and a more downstream portion 13 with the upstream portion 11 disposed relative to the expected direction of traffic and longitudinally disposed loadings from end-on impacts by errant vehicles.

In many respects, the terminal 10 is constructed and will operate in a manner similar to the slotted rail terminal described in U.S. Pat. No. 5,407,295 issued to Sicking et al., assigned to the assignee of the present invention and which is herein incorporated by reference. As FIG. 1 illustrates, and as will be explained in further detail shortly, the terminal 10 may be installed so as to diverge slightly from the roadway toward its upstream portion 11. A buffered end section (not shown) may be attached to the upstream portion 11 of the thrie-beam rail 12. The downstream portion 13 is fixedly attached to the adjoining guardrail 50 by means of bolts, rivets or other connection means.

Referring now to FIGS. 1 and 2, the terminal 10 includes a thrie-beam rail section 12 mounted on lead post 19 and support posts 18, 17, 16. As compared to a standard W-beam or other conventional guardrail, wherein the rail is mounted on the posts so as to present a relatively low and narrow barrier area, the thrie-beam rail presents a higher and wider barrier area more effective in stopping and slowing impacting trucks or other taller vehicles. A W-beam, for example, presents a barrier which is 12" wide from top to bottom of the barrier, the top of the barrier being 27" from the ground when mounted. The thrie-beam, on the other hand, has a top to bottom width of 20". When mounted on support posts, the top of the thrie-beam rail is 31" to 32" from the ground.

The terminal 10 includes a series of multiple slotted zones, indicated generally at 20, longitudinally spaced along the rail 12. It is preferred that each slotted zone 20 be approximately centered or placed at quarter-distance points between the exemplary support posts 19, 18, 17, 16. The number and spacing of support posts may vary in accordance with terrain and other location-specific details. The slotted zone 20 comprises one or more slots 22 longitudinally disposed in the thrie-beam 12. The use of five slots is preferred as it provides for a relatively uniform and effective reduction of the thrie beam's resistance to longitudinal loading. A preferred placement for slots 22 within a slotted zone 20 is better understood with reference to the details for the exemplary thrie-beam rail 12 shown in FIGS. 5 and 6. A pair of valleys 24 and 26 are positioned between peaks 28, 30, and 32, each peak being formed by the intersections of inclined web portions 34. Edge members 36 laterally outlie peaks 28 and 32. Highly preferred placement for slots 22 is at the center portion of each peak 28, 30, 32 and each valley 24, 26. The slots 22 should be of a size sufficient to reduce the ability of the rail to resist buckling in response to longitudinal loading from one end of the rail 12. Recommended sizes for the slots are approximately one-half inch in width and a minimum of 12" in length. However, the dynamic buckling strength of the guardrail terminal can be tuned to different desired levels by controlling the number and length of slots 22. Generally, larger and longer slots have reduced dynamic buckling strength to a greater degree as has a greater number of slots.

It is preferred that each slot 22 be reinforced proximate the downstream end of each slotted zone 20 to resist too great an expansion of the slot in an impact, which could result in tearing of the rail 12 and an uncontrolled stop of the vehicle. One suitable method of reinforcing downstream end of the slots 22 is through attachment of a "slot guard" 38 as described in further detail in U.S. Pat. No. 5,407,295. Other methods of reinforcement include use of thickened welds or plates bolted onto the beam 12 proximate the downstream end of the slots 22.

As best seen in FIGS. 2, 3 and 4, the lead post 19 is of the breakaway variety. The post 19 is inserted into a box-shaped foundation tube 40 which is buried to be nearly flush with the surface. The post 19 is preferably fashioned from wood which is readily frangible in a collision. A tension support cable 42 extends from the thrie-beam rail 12 to the lower portion of the lead post 19 where a hole 44 has been drilled therethrough. The support cable is maintained in tension and provides additional anchorage for the rail 12 during lateral impacts, i.e., impacts along the side of the rail rather than from its end. The upper end of the support cable 42 is attached to the rail 12, typically by means of a shoe 46 which holds the cable in place against the rail and which is attached to the rail 12 by bolts or welds. Usually, an unsupported portion of the rail 12 which is not within a slotted zone 20 is used for this connection. The lower end of support cable 42 passes through the hole 44. The end of the cable 42 is provided with a threaded fitting 47 upon which is fastened a nut 48 and washer 49. A slotted bearing plate 60 is positioned between the washer 49 and the lead post 19. When installed, the bottom edge of the slotted beating plate 60 rests on the ground, as shown by FIGS. 2 and 4.

The slotted bearing plate 60 presents a cable resting notch 62 proximate its center. A cutout portion 64 extends upward from the cable resting notch to the outer edge of the slotted beating plate. Outward of the cable resting notch 62, the cutout portion 64 must have a width at least as great as that of the cable fitting 47 such that the cable fitting 47 may be easily removed from the notch 62. It is greatly preferred that the cutout portion 64 have a much greater width so that the slotted beating plate 60 is relatively certain to fall away from the fitting 47 once the fitting 47 is moved outward from the notch 62 along the cutout section 64. One preferred shape for the cutout section, as shown in FIGS. 3 and 4, is a V-shaped slot which extends from the upper edge of the plate 60 to the notch 62.

In operation, the thrie-beam rail terminal 10 is typically positioned along a highway to prevent laterally impacting vehicles from penetrating the guardrail unimpeded and encroaching into the area shielded by the guardrail. It is intended that a vehicle will impact the guardrail terminal 10 downstream of its upstream portion 11 and on the side of the terminal 10 facing the roadway. Although the terminal 10 may be installed so that it is aligned with the guardrail to which it is attached, it is preferred that the terminal 10 extend angularly away from the roadway, as illustrated in FIG. 1. This angular departure facilitates "gating" of laterally impacting vehicles to the side of the rail opposite the roadway. Methods of installing the terminal at an angular departure are described in greater detail in U.S. Pat. No. 5,407,295.

During a collision with a vehicle which impacts the terminal 10 at its upstream portion 11, the rail portions which include the slotted zones 20 will buckle more readily than other sections of the rail 12. Due to the buckling, the rail should cushion the impact of the vehicle rather than bringing the vehicle to an abrupt, jolting halt.

Upon impact with the upstream portion 11, a vehicle travelling at a moderate to high speed will likely shear frangible lead post 19. As the thrie-beam rail 12 buckles at its slotted zones 20 and collapses with the impact, tension is placed upon the tension cable 42 in an upward and downstream direction. Once the lead post 19 is sheared away, the lower end of the cable 42 and the fitting 47 are pulled upward and downstream. Due to the presence of the cutout section 64, the fitting 47 is freed from the slotted beating plate 60.

Although described in terms of the preferred embodiments, those skilled in the art will recognize that the invention is susceptible to numerous modifications and variations which fall within the scope and spirit of the invention.

What is claimed:

1. A highway guardrail terminal for extending along a roadway, the terminal having an upstream portion and a downstream portion and comprising:

a thrie-beam rail having three peaks and two valleys;

a slotted section in the rail, the slotted section having a slot longitudinally disposed in the rail and of a size sufficient to reduce the ability of the rail to resist buckling in response to a longitudinal loading from an end of the rail, said slot having an upstream end and a downstream end; and a reinforced portion of the rail proximate the downstream end of the slot, a portion Of the slot extending beyond the reinforced portion toward the upstream portion of the terminal.

2. The highway guardrail terminal of claim 1 wherein the reinforced portion of the rail comprises a slot guard attached to the rail proximate the downstream end of the slot.

3. The highway guardrail terminal of claim 1 further comprising a cable release mechanism comprising:

a generally vertical support member supporting said thrie-beam rail, the support member having an aperture therethrough;

a cable having an end which is disposed through the aperture of the support member;

a fastener proximate said end of the cable which prevents withdrawal of said end of the cable from disposal through the aperture; and a release plate disposed between the fastener and the support member, the release plate having a cable resting notch and a cutout section to permit a cable resting within the cable resting notch to be removed from the plate.

4. The highway guardrail terminal of claim 3 wherein the cutout section comprises a V-shaped slot.

5. A highway guardrail terminal for extending along a roadway, the terminal having an upstream portion and a downstream portion and comprising:

a rail member;

at least one support member supporting the rail member, the support member having an aperture disposed therethrough;

a cable extending between a point along the rail and a lower portion of the support member, the cable having an end which is disposed through the aperture, the cable further being attached to the rail;

a fastener proximate said end which prevents withdrawal of said end of the cable from disposal through the aperture; and a release plate disposed between the fastener and the support member, the release plate having a cable resting notch and a cut out section to permit a cable resting within the cable resting notch to be removed from the plate.

6. A highway guardrail terminal for extending along a roadway, the terminal having an upstream portion and a downstream portion and comprising:

a thrie-beam rail having three peaks and two valleys;

a slotted section in the rail, the slotted section having a slot longitudinally disposed in the rail and of a size sufficient to reduce the ability of the rail to resist buckling in response to a longitudinal loading from an end of the rail, said slot having an upstream end and a downstream end;

a reinforced portion within the rail proximate the downstream end of the slot, the reinforced portion comprising a slot guard attached to the rail proximate the downstream end of the slot;

a cable release mechanism comprising a generally vertical frangible support post supporting the thrie-beam rail, the support member having an aperture therethrough;

a cable having an end which is disposed to the aperture of the support member;

a fastener proximate the end of the cable which prevents withdrawal of the end of the cable from disposal through aperture and a release plate disposed between the fastener and the support member, the release plate having a cable resting notch and a V-shaped slot cutout section to permit a cable resting within the cable resting notch to be removed from the plate.

* * * * *